US011898560B1

(12) United States Patent
Baldenko et al.

(10) Patent No.: US 11,898,560 B1
(45) Date of Patent: Feb. 13, 2024

(54) WORKING MEMBERS OF A ROTARY HYDRAULIC OR PNEUMATIC MACHINE

(71) Applicant: Perfobore Inc., Road Town (VG)

(72) Inventors: Dmitry Fedorovich Baldenko, Moscow (RU); Fedor Dmitrievich Baldenko, Moscow (RU); Ilya Alexandrovich Lyagov, Ufa (RU); Alexander Vasilievich Lyagov, Ufa (RU); Yang Yao, Beijing (CN)

(73) Assignee: PERFOBORE INC., Road Town (VG)

( * ) Notice: Subject to any disclaimer, the term of this patent is extended or adjusted under 35 U.S.C. 154(b) by 0 days.

(21) Appl. No.: 17/871,399

(22) Filed: Jul. 22, 2022

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/10*** | (2006.01) |
| ***F04C 18/10*** | (2006.01) |
| ***F04C 18/08*** | (2006.01) |
| ***F04C 2/08*** | (2006.01) |

(52) U.S. Cl.
CPC ..... *F04C 2/103* (2013.01); *F04C 2/084* (2013.01); *F04C 18/084* (2013.01); *F04C 18/10* (2013.01); *F04C 2250/301* (2013.01)

(58) Field of Classification Search
CPC .. F04C 2/08; F04C 2/082; F04C 2/084; F04C 2/086; F04C 2/103; F04C 2/10731; F04C 2/1073; F04C 2/1075; F04C 18/08; F04C 18/082; F04C 18/084; F04C 18/086; F04C 18/10; F04C 18/1075; F04C 2/1071; F04C 2250/301
See application file for complete search history.

(56) References Cited

U.S. PATENT DOCUMENTS 3,288,034 A * 11/1966 White, Jr. ..... F04C 2/104 418/61.3
4,036,031 A * 7/1977 Woodling ..... F01C 17/02 418/61.3

FOREIGN PATENT DOCUMENTS

CN 2294344 Y 10/1998
CN 1760552 A 4/2006
(Continued)

OTHER PUBLICATIONS

RU-192348-U1—Baldenko F D—Ellipscycloidal Gear Clip—Sep. 13, 2019—the English Machine Translation. (Year: 2019).*
(Continued)

*Primary Examiner* — Theresa Trieu
(74) *Attorney, Agent, or Firm* — BCF LLP

(57) ABSTRACT

The utility model relates to internal cycloidal gear mechanisms and can be used in various branches of mechanical engineering as working members of hydraulic machines (pumps and engines), compressors, internal combustion engines, as well as in planetary gearboxes, in particular in technical systems for drilling and repairing oil and gas wells. The problems to be solved by the utility model include the improvement of the quality of the process of designing working members having a cycloidal tooth profile, as well as the substantiation of the conditions for modifying cycloidal face profiles (by choosing the required combination of dimensionless gearing coefficients) in order to achieve the maximum or minimum open area of the gerotor mechanism having a different kinematic ratio.

2 Claims, 9 Drawing Sheets

$i$ =2:3; $D_b/e$ = 30; $c_0$ = 5; $c_e$ = 4; $c_d$ = 0 (from common rack)

(56) References Cited

FOREIGN PATENT DOCUMENTS

| | | | | | |
|---|---|---|---|---|---|
| CN | 1888372 | A | | 1/2007 | |
| CN | 101656438 | A | | 2/2010 | |
| CN | 104712555 | A | * | 6/2015 | ..... F04C 2/084 |
| CN | 113153741 | A | | 7/2021 | |
| RU | 2162926 | C1 | | 2/2001 | |
| RU | 2166603 | C1 | | 5/2001 | |
| RU | 2309237 | C1 | | 10/2007 | |
| RU | 2345208 | C1 | * | 1/2009 | |
| RU | 192348 | U1 | * | 9/2019 | ..... F16H 1/10 |
| WO | WO-2004020826 | A2 | * | 3/2004 | ..... F01C 1/084 |

OTHER PUBLICATIONS

RU 2162926C1—Baldenko et al.—Gerotor Mechanism—Feb. 10, 2001—the English Machine Translation. (Year: 2001).*

WO-2004020826-A2—Baldenko D F—Gerotor Mechanism—Mar. 11, 2004—the English Machine Translation. (Year: 2004).*

RU2345208C1—Dvoynikov M V—Gerotor Machine—Jan. 27, 2009—the English Machine Translation. (Year: 2009).*

"Gerotor mechanism", Inventor's Certificate USSR No. 803572, Oct. 8, 1979 (Aug. 10, 1979).

Industry Standard (OST) 39-164-84, "Rotor-stator gear arrangement of a screw downhole motor. Basic profile. Geometry calculation", Published on May 24, 1984.

* cited by examiner (a) $i = 2:3$; $D_R/e = 11.05$; $c_0 = 1.175$; $c_6 = 2.175$; $c_4 = 0$ (b) $i = 5:6$; $D_R/e = 18.1$; $c_0 = 1.175$; $c_6 = 2.175$; $c_3 = 0$ (c) $i = 9:10$; $D_R/e = 27.5$; $c_0 = 1.175$; $c_6 = 2.175$; $c_4 = 0$ (a) $i$ = 2:3; $D_R/e$ = 7; $c_0$ = 1.1; $c_e$ = 0.8; $c_d$ = −0.5

(b) $i$ =5:6; $D_R/e$ = 13.1; $c_0$ = 1.1; $c_e$ = 1; $c_d$ = −0.95

(c) $i$ =9:10; $D_R/e$ = 22.2; $c_0$ = 1.2; $c_e$ = 1.7; $c_d$ = − 2.4

(a) $i$ =3:4; $D_g/e$ = 9.2; $c_\theta$ = 1.2; $c_e$ = 0; $c_d$ = 0

(b) $i$ =3:4; $D_g/e$ = 9.2; $c_\theta$ = 1,2; $c_e$ = 0.5; $c_d$ = – 0.5

(c) $i$ =3:4; $D_g/e$ = 9.2; $c_\theta$ = 1.1; $c_e$ = 0.7; $c_d$ = – 0.4

(a) $i$ =3:4; $D_w/e$ = 19.5; $c_0$ = 1.25; $c_e$ = 4; $c_d$ = 1

(b) $i$ =3:4; $D_w/e$ = 60; $c_0$ = 8; $c_e$ = 4; $c_d$ = 1

(c) $i$ =3:4; $D_w/e$ = 60; $c_0$ = 8; $c_e$ = 4; $c_d$ = 1 (from common rack)

$i$ =2;3; $D_g/e$ = 30; $c_0$ = 5; $c_e$ = 4; $c_\Delta$ = 0 (from common rack)

(a) $i$ =5:6; $D_k/e$ = 13; $c_0$ = 1.1; $c_e$ = 1; $c_\Delta$ = – 0.95; $S/D_k^2$ = 0.18

(b) $i$ =5:6; $D_k/e$ = 25; $c_0$ = 1.5; $c_e$ = 2.5; $c_\Delta$ = 1.5; $S/D_k^2$ = 0.12

WORKING MEMBERS OF A ROTARY HYDRAULIC OR PNEUMATIC MACHINE

FIELD

The present technical solution relates to internal gear mechanisms and can be used for mechanical engineering in the form of working members of straight tooth and helical tooth hydraulic and pneumatic machines, as well as in internal combustion engines and planetary gearboxes.

BACKGROUND

There is known an internal cycloidal gear mechanism used as a working member of multi-lobe screw downhole motors for drilling wells, in which a tooth difference between the stator and rotor thereof is equal to one, the conjugate face profiles of which are formed as envelope equidistants of a shortened cycloidal rack when it is rolling-in around the base circle (Gerotor mechanism, Inventor's Certificate U.S. Pat. No. 803,572, Aug. 10, 1979).

In the general case, the geometry of a cycloidal tooth profile gerotor mechanism for any kinematic ratio and type of gearing (epi- or hypo-) is determined by a combination of three dimensionless geometric coefficients (eccentricity, tooth shape and rack displacement), which complicates the manufacturing technology and the choice of the optimal shape of the profiles described by complex mathematical equations depending on the combination of the above three dimensionless coefficients.

Based on the study and optimization of the above method for constructing a cycloidal face profile in the practice of designing and manufacturing the working members of a gerotor mechanism, the geometric parameters of the face profile are standardized to a generalized form, in which for each kinematic ratio of the three dimensionless gearing coefficients, two coefficients (eccentricity and tooth shape) are taken to be constant, and the third one (displacement coefficient) is assigned based on the given profile diameter, taking into account the need to maintain the smoothness of the operating contour (Industry Standard (OST) 39-164-84. Rotor-stator gear arrangement of a screw downhole motor. Basic profile. Geometry calculation).

In the case of constructing a cycloidal face profile under OST 39-164-84, the ratio between the contour diameter of the working members (by the stator teeth cavities) and the gear eccentricity is a free parameter that is not regulated in the designing process.

The disadvantage of the above approach to the construction of the face profile of the gerotor mechanism, which ensures the standardization of design solutions and the unification of the parameters of the gear-cutting tool, is the impossibility of achieving extreme (maximum or minimum) values of the open area, which in some cases is a necessary condition for calculating the gerotor mechanism in order to ensure the highest possible frequency rotation or torque of a rotary hydraulic or pneumatic machine.

SUMMARY

The utility model has the object of establishing a relationship between the geometric parameters of the cycloidal face profile, ensuring the achievement of the maximum or minimum open area of the gerotor mechanism in order to design the working members of a rotary hydraulic or pneumatic machine having the maximum possible value of rotational speed or torque.

To achieve the above-described object, when designing the working members of a rotary hydraulic or pneumatic machine manufactured in the form of a gerotor mechanism having a cycloidal face profile of the stator and rotor, the number of teeth ($z_1$; $z_2$) of which differs by one, the ratio between the contour diameter (by the stator teeth cavities) $D_\kappa$ and the gear eccentricity e ($D_\kappa/e$), which depends on the combination of dimensionless geometric coefficients (eccentricity $c_o=r/e$, tooth shape $c_e=r_\mu/e$ and displacement $c_\Delta=\Delta_1/e$) used in the formation of the face profile by the method of running-in a cycloidal rack is assigned in the range that ensures the achievement of the maximum or minimum open area for a given kinematic ratio $i=z_2:z_1$ while maintaining the smoothness of the teeth contours and the absence of interference of the conjugate profiles in case they are formed from a common rack.

Moreover, by varying the numerical values of the above dimensionless geometric coefficients, various forms of conjugate profiles of gears (rotor and stator) and their modification, which ensures the achievement of extreme values of the open area, depending on the design and technological conditions when creating working members can be obtained.

BRIEF DESCRIPTION OF THE DRAWINGS

The present utility model will be further explained by the following description and drawings.

DETAILED DESCRIPTION

In many branches of mechanical engineering (for example, in the oil and gas industry), volumetric rotary hydraulic and pneumatic machines with internal gearing of working members (rotor-stator pair) have found application. The face profiles of the working members of these machines are closed periodic curves, the angular pitch of which is inversely proportional to the number of teeth.

Figure 1:
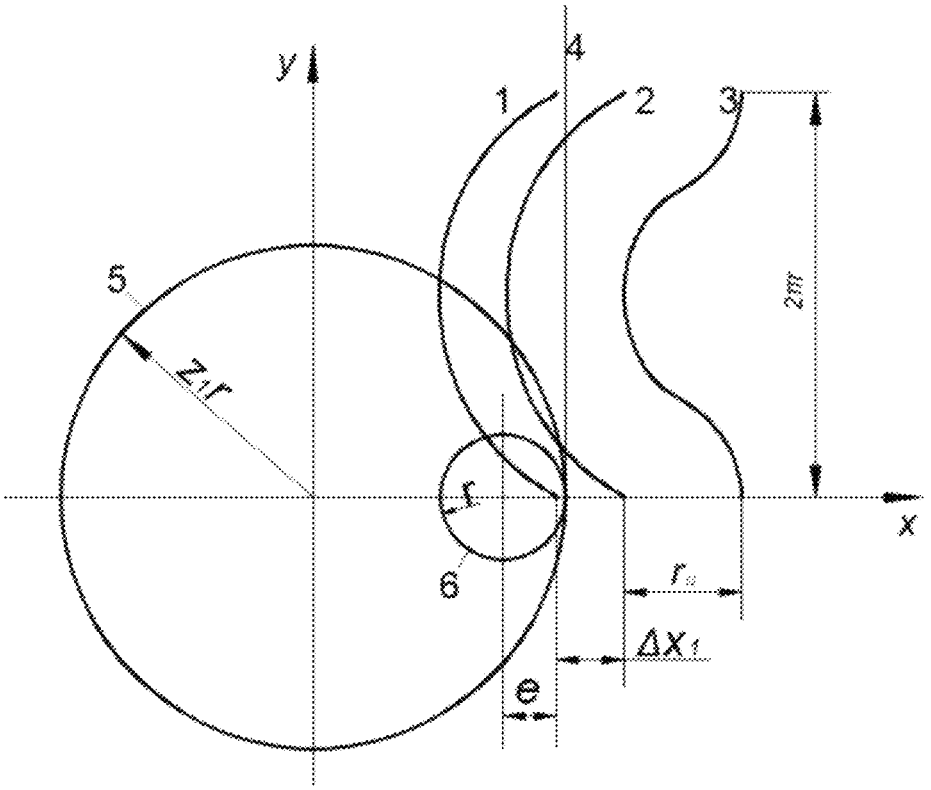
FIG. 1 shows a general scheme of formation of a cycloidal face profile by the method of rolling-in a basic profile of a cycloidal rack, taking into account the possibility of the rack displacement relative to the generating line.

For most design schemes of rotary hydraulic and pneumatic machines, a rotor performs planetary motion, and the face profiles of the working members thereof, called a "gerotor mechanism", are cycloidal and are formed from the equidistant hypo- and epicycloids or, in the general case, as envelopes of an equidistant 3 of a shortened cycloidal rack 2 (in the general case, displaced relative to the nominal position 2, obtained by rolling a generating circle of a unit radius 6 along a generating straight line 4) when it is rolling-in around a base circle 5 (FIG. 1).

The shape and curvature of the profile of a cycloidal wheel for a given contour diameter $D_\kappa$ is completely determined by three dimensionless geometric coefficients:

eccentricity coefficient $c_0=r/e$;

tooth shape coefficient $c_e=r_\mu/e$;

rack displacement coefficient $c_\Delta=\Delta x_1/e$, where r—generating circle radius; e—eccentricity; $r_\mu$—equidistant radius; $\Delta x_1$—displacement of the basic rack contour (FIG. 1).

With a different combination of dimensionless coefficients, it is possible to obtain face profiles of a gerotor mechanism having a given kinematic ratio, which will have different geometric parameters, including the open area (as the difference between the areas of the stator 110 and rotor 120 profiles).

Figure 2:
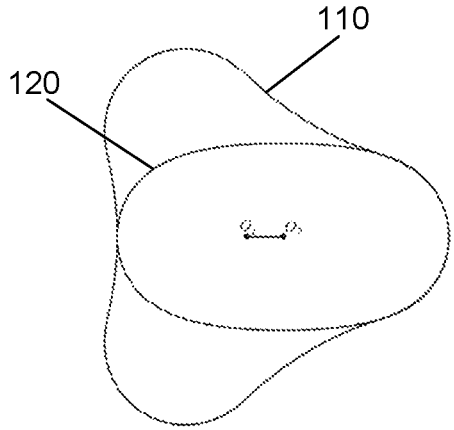
FIG. 2 shows hypocycloidal face profiles of multi-lobe gerotor mechanisms having different kinematic ratios (2:3; 5:6; 9:10) in the reference case of the formation thereof (in the absence of the rack contour displacement when constructing the basic profile and using the standardized values of the eccentricity and tooth shape coefficients).
Figure 2:
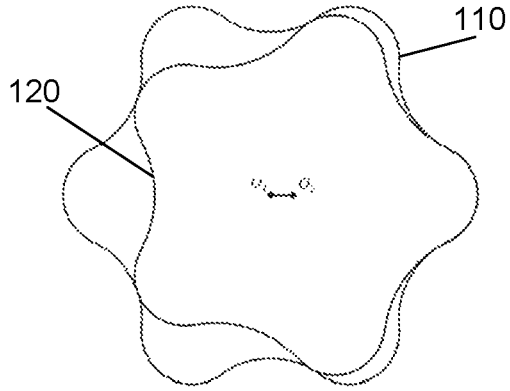
Figure 2:
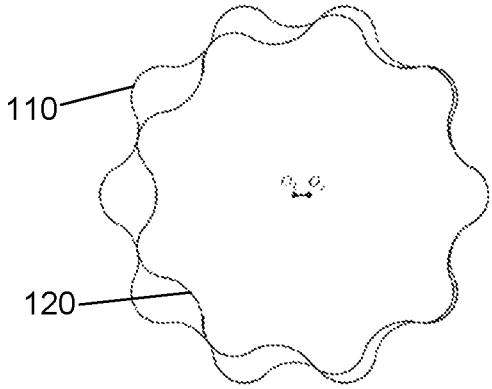

FIG. 2 shows the reference hypocycloidal profiles having different kinematic ratios (2:3; 5:6; 9:10), constructed by the rolling-in method in the absence of a displacement of the basic rack contour, the rack having shape of the teeth under OST 39-164-84. Points $O_1$ and $O_2$, displaced at the eccentricity distance e, belong to the centers of the sections of the stator 110 and rotor 120, respectively. As can be seen, with an increase in the number of teeth, the open area of the working members, which is the sum of the individual working chambers, decreases, but at the same time, the multiplicity of the action of the gerotor mechanism in the process of its operation increases.

The open area is one of the factors that determine the working volume of a hydraulic or pneumatic machine and has a direct impact on their main technical indicators (speed, torque, pressure drop).

Under certain conditions, when designing the working members of the machine, it is necessary to select such a shape of cycloidal profiles that will ensure the achievement of the maximum or minimum value of the open area of the gerotor mechanism in order to ensure the maximum possible speed or torque of the hydraulic machine.

To construct a face profile having an extreme value of the open area, it is required to establish the necessary relationships between the geometric dimensions of the gears. However, to date, the theory of cycloidal gearing has not provided generalized data on the choice of optimal combinations of geometric parameters of the profile, in particular, between the contour diameter (by the stator tooth cavities) and the gear eccentricity $D_\kappa/e$ for a given kinematic ratio of the gerotor mechanism.

In the case of building face profiles under OST 39-164-84, when two dimensionless coefficients are taken to be constant, and the third coefficient ($c_\Delta$) is assigned based on the given values of the contour diameter and gear eccentricity, it is not possible to achieve an extreme open area due to a non-optimal choice of eccentricity and tooth shape coefficients in relation to the open area of the gerotor mechanism, which is due to the fact that here the ratio $D_\kappa/e$ is a free parameter that is not strictly regulated in the design process.

The standardized approach to the designing of a cycloidal face profile limits the possibility of choosing the optimal geometric parameters and improving the characteristics of a hydraulic or pneumatic machine, since its implementation does not take into account the required combination between the diametrical size and the eccentricity (center distance) of the gerotor mechanism.

In the general case, the dependence of the ratio De on the number of rotor lobes for a gerotor mechanism with a cycloidal tooth profile can be represented as follows $$\frac{D_k}{e} = 2(z_2c_0 + c_e + c_\Delta + 1), \tag{1}$$

where $z_2$—number of rotor teeth (inner wheel), $z_2=z_1-1$.

If, for a given contour diameter $D_\kappa$, it is required to ensure a constant eccentricity e and teeth height (h=2e), the following relationship should be established between the dimensionless profile coefficients:

$$z_2c_0+c_e+c_\Delta+1=\text{const} \tag{2}$$

The calculation results show that at $D_\kappa/e$=const, the areas of individual chambers of the gerotor mechanism remain almost constant, despite the different configuration of the face profiles of the rotor 120 and stator 110 when the geometric coefficients are changed in accordance with expression (2). This conclusion can be applied in the building a cycloidal face profile, which has an extreme value of the open area S for a given diametrical size and kinematic ratio of the working members.

With this approach, when designing the working members of a rotary hydraulic or pneumatic machine, manufactured in the form of a gerotor mechanism having a cycloidal face profile of the stator 110 and rotor 120, the number of teeth of which differs by one, the ratio between the contour diameter and the gear eccentricity ($D_\kappa/e$), which depends on the combination of dimensionless geometric coefficients (eccentricity $c_o$, tooth shape $c_e$ and displacement $c_\Delta$) used in the formation of the face profile by the method of tolling-in of a cycloidal rack, is assigned based on the achievement of the maximum or minimum open area for a given kinematic ratio $i=z_2:z_1$ while maintaining the smoothness of the tooth contours and the absence of interference of the conjugate rotor 120 and stator 110 profiles.

For each kinematic ratio (lobe) of the gerotor mechanism, there is a range of change in the dimensionless parameter $D_\kappa/e$, which ensures the achievement of an extreme open area, subject to the conditions for the absence of curvature breaks and interference (intersections) of the profiles.

Figure 3:
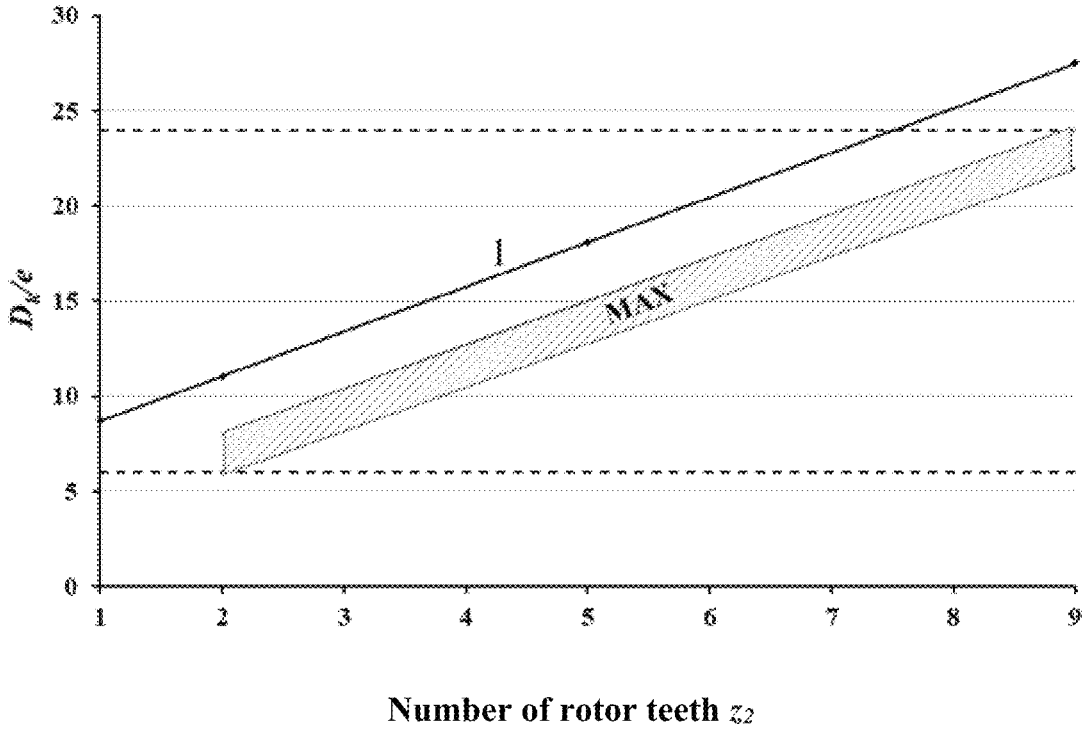
FIG. 3 shows graphs of the dependence of the dimensionless coefficient De on the number of rotor lobes for the reference gerotor mechanism ($c_o$=1.175; $c_e$=2.175), and the proposed profile for changing the coefficient $D_\kappa/e$, ensuring the achievement of the maximum open area.
Figure 4:
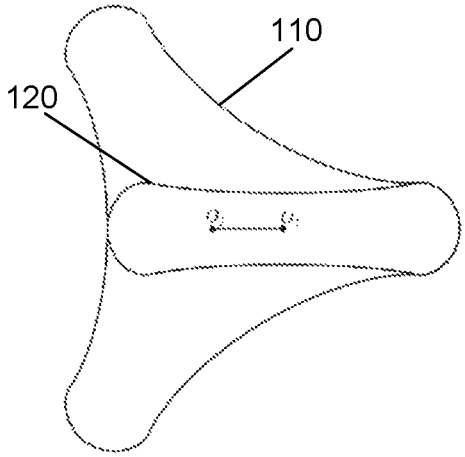
FIG. 4 shows hypocycloidal face profiles having a kinematic ratio of 2:3; 5:6; 9:10 and the required combination of dimensionless coefficients, ensuring the maximum open area while maintaining the smoothness of the tooth contours.
Figure 4:
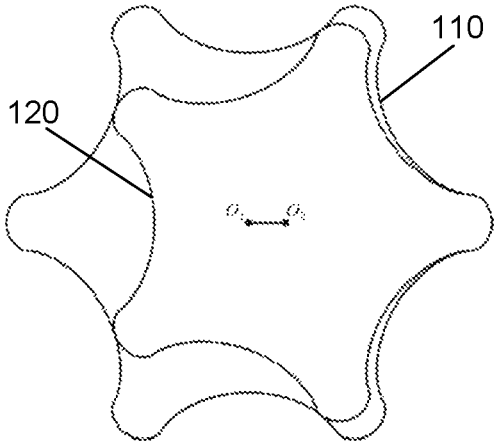
Figure 4:
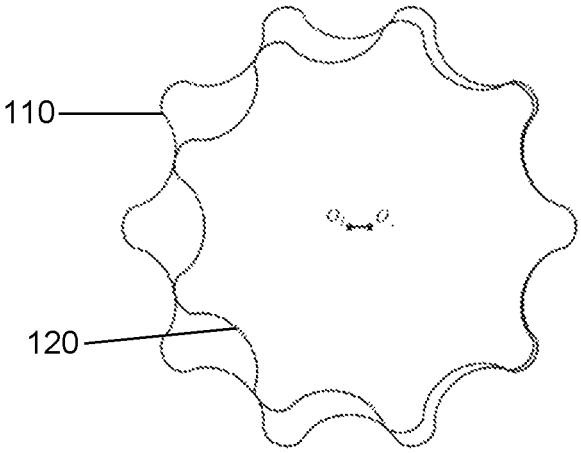

Numerical values of these ranges, corresponding to the maximum open area for multi-lobe working members, are shown in FIG. 3 as a shaded outline.

This outline does not intersect with the graph $D_к/e$ (line 1) for a gerotor mechanism having a reference cycloidal tooth profile (FIG. 2), which confirms that this option is not optimal when creating a machine with a maximum working volume.

The designing of the face profile having the optimal value of the dimensionless parameter $D_к/e$ is variable and can be carried out by choosing the required combination between the geometric coefficients ($c_o$, $c_e$, $c_\Delta$) in accordance with expression (2). At the same time, varying displacement coefficient ($c_o$; $c_e$–const) only, limits the designing possibilities and, for a given diametrical dimension ($D_к$=cons), does not allow changing the open area S by more than 25%.

As a result, when designing the working members of a rotary hydraulic or pneumatic machine in order to achieve the maximum open area, the dimensionless geometric coefficients of the cycloidal face profile are assigned in the following ranges:

$$D_к/e=6 \ldots 24$$

$$c_o=1.05 \ldots 1.2$$

$$c_e=0 \ldots 1.75$$

$$c_\Delta=-2.5 \ldots 0.5,$$

whereas lower values of the coefficient $D_к/e$ refer to gerotor mechanisms having a small number of teeth.

Figure 5:
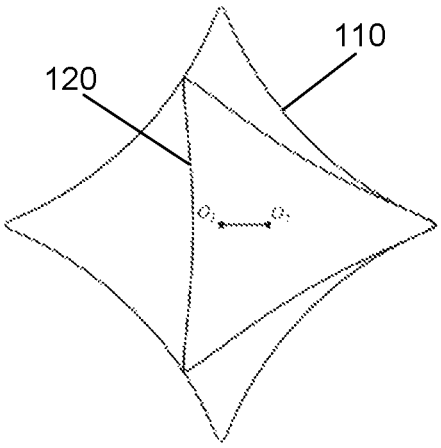
FIG. 5 shows alternative embodiments of hypocycloidal face profiles having maximum open area for a mechanism having a kinematic ratio of 3:4 for various combinations of profile coefficients ($c_o$, $c_e$, $c_\Delta$), ensuring the constancy of the dimensionless coefficient $D_\kappa/e$=9.2 and the open area ($S/D_\kappa^2$=0.2).
Figure 5:
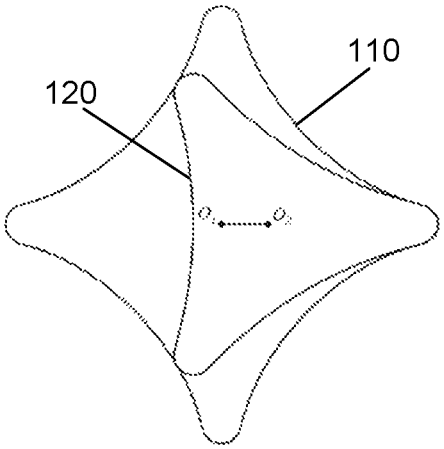
Figure 5:
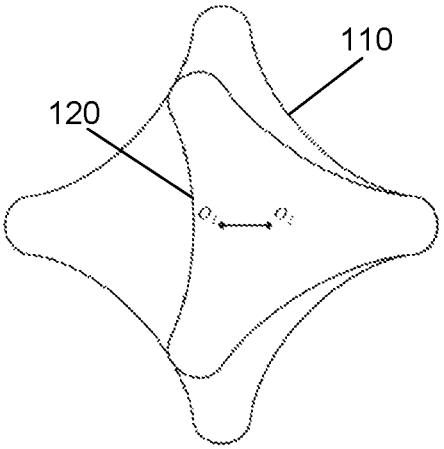

As an example of the proposed technique for constructing a cycloidal profile, FIG. 5 shows three possible embodiments of the working members of the gerotor mechanism of a kinematic ratio of 3:4 having a maximum open area ($S/D_к^2$=0.20) and a different combination of dimensionless profile coefficients at a constant ratio $D_к/e$=9.2, corresponding to the proposed outline shown in FIG. 3.

The choice of the final embodiment of the gerotor mechanism having the maximum open area is made on the basis of a comparison of geometric (in particular, the reduced contour curvature, tooth height), kinematic (sliding speed, inertial force) and technological parameters, taking into account the type of machine being designed and the specified operating conditions.

When designing working members having a minimum open area using an ideal method of constructing profiles (when the conjugate profile is constructed as an envelope of the basic profile when they are running-in around the pitch circles), it is possible to obtain a gerotor mechanism with any required area of the open area (FIGS. 6*a*, 6*b*) theoretically reaching zero values (in this case, $D_к/e \rightarrow \infty$, and the rotor and stator profiles tend to a circle).

Figure 6:
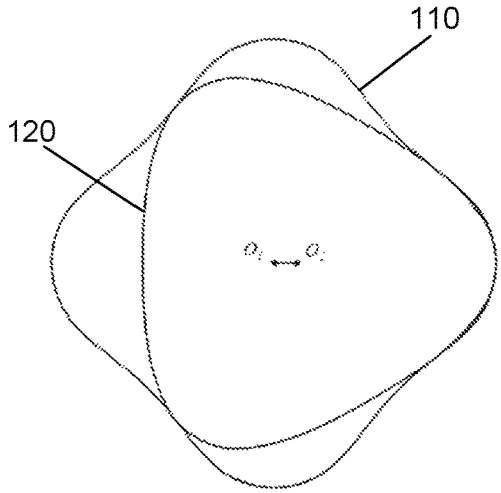
FIG. 6 shows examples of the formation of a hypocycloidal face profile having minimum open area for a mechanism having a kinematic ratio of 3:4 in the absence of interference of conjugate profiles (FIGS. 6*a*, 6*b*) and in the presence of interference of the rotor and stator profiles in the case of their formation from a common cycloidal rack (FIG. 6*c*).
Figure 6:
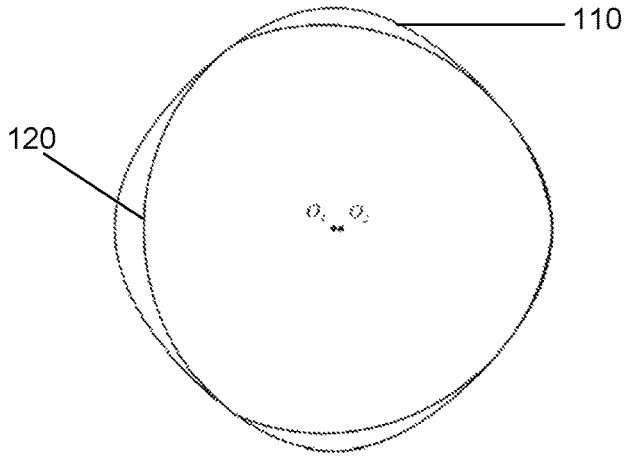
Figure 6:
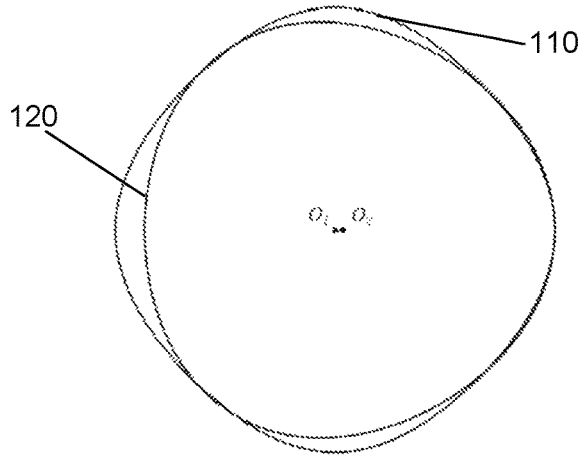

However, if the original and conjugate profiles are constructed from a common contour of the cycloidal rack shown in FIG. 1 (which is often used in practice in order to reduce the cost of designing and manufacturing a gear-cutting tool), obtaining a face profile having a minimum open area is limited by the condition of the absence of interference of the conjugate profiles of the rotor 120 and stator 110 (FIG. 6*c*). In this case, when designing a profile, it is advisable to assign an eccentricity coefficient close to one, and the combination of the coefficients $c_e$ and $c_\Delta$ should be taken from the condition of the minimum intersection of the profiles.

Figure 7:
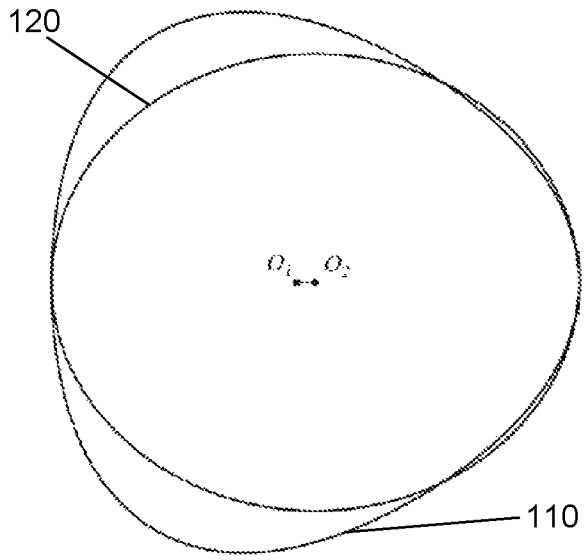
FIG. 7 shows a gerotor mechanism having a kinematic ratio of 2:3, constructed from a common rack and characterized by a noticeable interference of conjugate profiles.

An example of a gerotor mechanism with a pronounced interference of conjugate profiles due to the high value of the eccentricity coefficient is shown in FIG. 7. The use of this option is possible when using a stator with an elastic lining.

In the general case, when designing gerotor mechanisms having a minimum open area, one can take $$D_к/e>15 \ldots 30,$$

wherein lower values of the coefficient $D_к/e$ refer to gerotor mechanisms with a small number of teeth.

Moreover, in the final choice of a gerotor mechanism having a minimum open area, it is necessary to take into account the value of the hydraulic radius, which determines the drag coefficient and hydraulic losses in the working pair, especially when operating on viscous liquids and gas-liquid mixtures.

Figure 8:
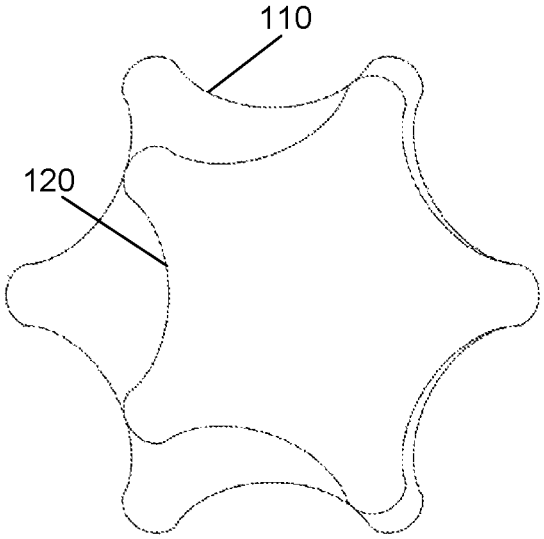
FIG. 8 shows for comparison the face profiles of a gerotor mechanism having a kinematic ratio of 5:6 with the maximum and minimum open areas for various values of the parameter $D_\kappa/e$.
Figure 8:
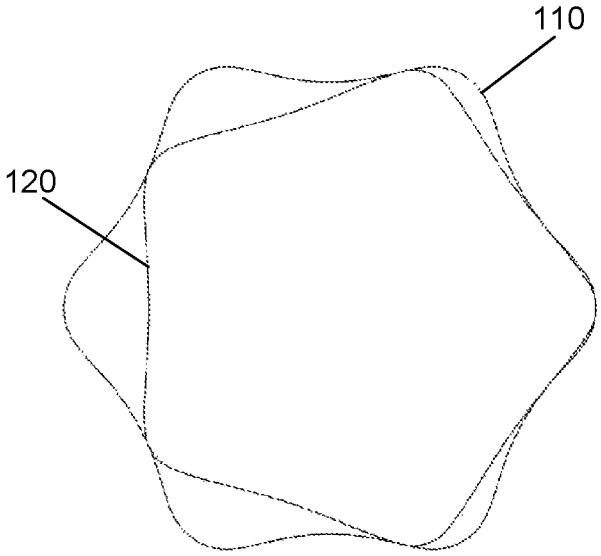

To summarize the possible implementation of the utility model, FIG. 8 shows embodiments of the face profiles of the mechanism having a kinematic ratio of 5:6, ensuring the maximum and minimum open areas (the area change is 50%) by varying the dimensionless geometric coefficients.

The technical result of the proposed utility model is to improve the quality of the process of designing the working members of cycloidal tooth profile rotary hydraulic and pneumatic machines, as well as the rationale for the conditions for modifying cycloidal face profiles in order to achieve the maximum or minimum open area of the gerotor mechanism having a different kinematic ratio, which creates the preconditions for further improving the efficiency of the use of volumetric rotary machines in various branches of mechanical engineering.

For example, for the Perfobur technical system, designed to carry out works that provide the possibility of exploiting low-power productive formations in oil and gas wells by drilling channels of ultra-small diameter of 60 . . . 70 mm and a length of up to 14 meters from the main wellbore along a predicted trajectory when re-opening through a pre-milled "window" in the casing string, special small-sized cycloidal screw downhole motors (SDM) having an outer casing diameter of not more than 43 . . . 49 mm are required. Such engines, by means of a wedge-deflector, which is part of the Perfobur technical system, are able to ensure entry at an angle of 5 . . . 7 degrees relative to the axis of the main borehole at a rate of curvature angle increase during drilling up to 10 deg./m (A small-sized hydraulic downhole motor drilling assembly. Utility model patent No. 195139, 25. 12. 2017).

Figure 9:
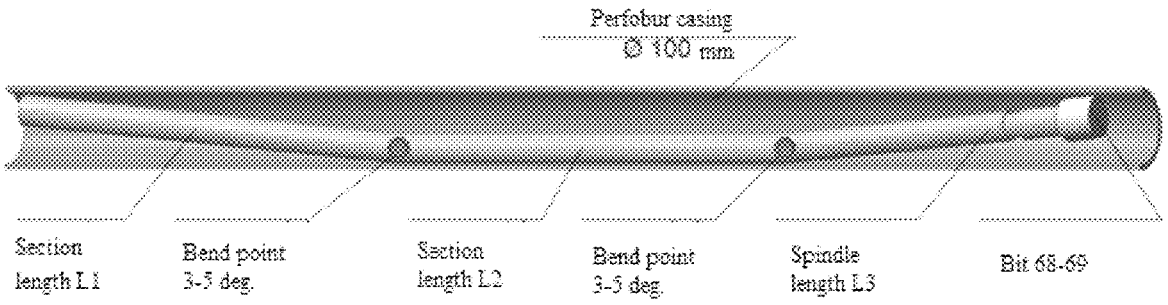
FIG. 9 shows a layout of a screw downhole motor having two bend angles in the casing of the Perfobur technical system.
Figure 10:
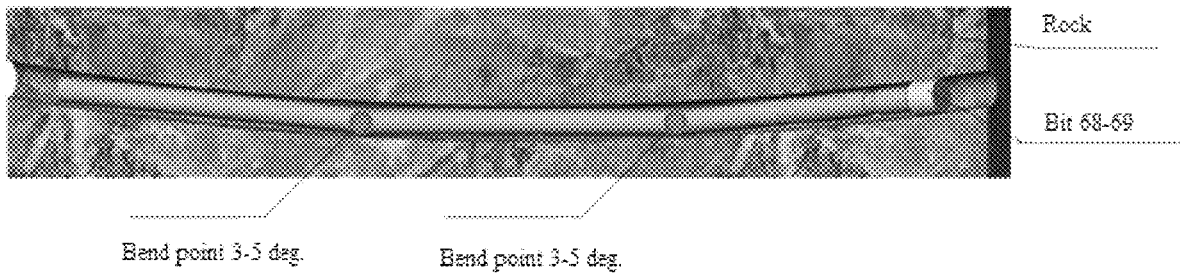
FIG. 10 shows a layout of a downhole screw motor having two bend angles in the radial bore of the well hole.

FIGS. 9 and 10 show the layout of a small-sized SDM with two bend angles, respectively, in the casing of the Perfobur technical system and in the radial bore of the well hole having a radius of curvature of 7 . . . 9 m.

One of the problems in the designing a hydraulic motor for the above technical system, as well as the inefficiency of using serial small-sized SDMs, is determined by the need to provide the required high level of engine torque, which depends on the possibility of achieving the maximum values of the open area and working volume in a limited diametrical and axial dimensions, which can be implemented on the basis of the technical solutions proposed in the application for choosing the shape of the cycloidal face profile of the working members.

The developed hydraulic motor having a diameter of 49 mm, the working members of which were made in strict accordance with the shape of the cycloidal face profile proposed in the application for the utility model by varying the dimensionless geometric coefficients ($D_к/e$=6 . . . 24; $c_o$=1.05 . . . 1.2; $c_e$=0 . . . 1.75; $c_\Delta$=−2.5 . . . 0.5), was tested at the production site of Perfobur company (Ufa) on a specialized test bench that allows simulating the operating conditions of the technical system in the well with registration of the necessary parameters for selecting the optimal modes of operation of the equipment by means of instrumentation and special software installed on the stand, which allows, based on the data obtained, to build graphs of the characteristics of all elements of the system in real time.

During testing in various modes, the engine developed torque at a maximum power of up to 200 N·m, which meets the basic technical requirements for the implementation of the drilling technology under consideration and characterizes the industrial utility of the proposed utility model.

The invention claimed is:

1. Working members of a rotary hydraulic or pneumatic machine manufactured in the form of a gerotor mechanism having a stator and a rotor, wherein the stator and the rotor have a cycloidal face profile, wherein a number of teeth of the stator is one more than a number of teeth of the rotor, wherein a ratio between a contour diameter (by cavities of teeth of the stator) $D_\kappa$ and a gear eccentricity e ($D_\kappa/e$), which depends on a combination of dimensionless geometric coefficients (eccentricity coefficient $c_o=r/e$, tooth shape coefficient $c_e=r_\mu/e$ and displacement coefficient $c_\Delta=\Delta x_1/e$) used in the formation of the cycloidal face profile by a method of running-in a cycloidal rack is assigned based on achievement of a maximum open area for a given kinematic ratio $i=z_2:z_1$ while maintaining smoothness of teeth contours and an absence of interference of conjugate profiles, where r—generating circle radius;

$r_\mu$—equidistant radius;

$\Delta x_1$—displacement of the basic rack contour relative to the generating line;

$z_1$, $z_2$—number of stator and rotor teeth; and wherein the dimensionless geometric coefficients of the cycloidal face profile are in the following ranges:

$$D_\kappa/e=6 \text{ to } 24,$$

$$c_o=1.05 \text{ to } 1.2,$$

$$c_e=0 \text{to } 1.75,$$

$$c_\Delta=-2.5 \text{ to } 0.5, \text{ and}$$

wherein lower values of the ratio $D_\kappa/e$ correspond to a smaller number of teeth of the stator and of the rotor.

2. Working members of a rotary hydraulic or pneumatic machine manufactured in the form of a gerotor mechanism having a stator and a rotor, wherein the stator and the rotor have a cycloidal face profile, wherein a number of teeth of the stator is one more than a number of teeth of the rotor, wherein a ratio between a contour diameter (by cavities of teeth of the stator) $D_\kappa$ and a gear eccentricity e ($D_\kappa/e$), which depends on a combination of dimensionless geometric coefficients (eccentricity coefficient $c_o=r/e$, tooth shape coefficient $c_e=r_\mu/e$ and displacement coefficient $c_\Delta=\Delta x_1/e$) used in the formation of the cycloidal face profile by a method of running-in a cycloidal rack is assigned based on achievement of a minimum open area for a given kinematic ratio $i=z_2:z_1$ while maintaining smoothness of teeth contours and an absence of interference of conjugate profiles, where r—generating circle radius;

$r_\mu$—equidistant radius;

$\Delta x_1$—displacement of the basic rack contour relative to the generating line;

$z_1$, $z_2$—number of stator and rotor teeth;

wherein the ratio between the contour diameter and the sear eccentricity of the cycloidal face profile $D_\kappa/e$ ranges between 15 to 30 based on the combination dimensionless geometric coefficients with the eccentricity coefficient $c_o$ close to one, and the combination of the coefficients ce and $c_\Delta$ are a minimum intersection of the conjugate profiles; and wherein lower values of the ratio $D_\kappa/e$ correspond to a smaller number of teeth of the stator and of the rotor.

* * * * *